US005735427A

United States Patent [19]

Hunter et al.

[11] Patent Number: 5,735,427

[45] Date of Patent: Apr. 7, 1998

[54] OPEN TOP CONTAINER

[75] Inventors: John H. Hunter, Placerville; Charles F. Hudson, Rowland Hts, both of Calif.

[73] Assignee: Russell-Stanley Corporation, Redbank, N.J.

[21] Appl. No.: 546,976

[22] Filed: Oct. 23, 1995

[51] Int. Cl.[6] ..... B65D 45/16

[52] U.S. Cl. ..... 220/324; 220/295; 220/301; 206/508; 206/519

[58] Field of Search ..... 220/293, 295, 220/297, 301, 324; 206/508, 519

[56] References Cited

U.S. PATENT DOCUMENTS

| | | | |
|---|---|---|---|
| 664,555 | 12/1900 | Jewett . | |
| 3,076,577 | 2/1963 | Craig | 220/297 |
| 3,203,578 | 8/1965 | Previte | 220/301 X |
| 3,307,739 | 3/1967 | Cloyd et al. | 206/508 |
| 3,514,010 | 5/1970 | Rossi | 220/293 |
| 3,811,597 | 5/1974 | Frankenberg et al. . | |
| 3,854,582 | 12/1974 | Martinelli | 206/508 |
| 4,333,580 | 6/1982 | Sweigart, Jr. . | |
| 4,585,138 | 4/1986 | Jonkers . | |
| 4,828,129 | 5/1989 | Jonkers . | |
| 5,020,839 | 6/1991 | Kalb . | |
| 5,143,389 | 9/1992 | Jonkers . | |

FOREIGN PATENT DOCUMENTS

| | | | |
|---|---|---|---|
| 1058230 | 12/1958 | Germany | 220/297 |
| 7503452 | 9/1976 | Netherlands . | |

*Primary Examiner*—Stephen Cronin
*Attorney, Agent, or Firm*—Hedman, Gibson & Costigan, P.C.

[57] ABSTRACT

An open top container having a drum and a lid wherein the lid engages the drum for sealing the contents thereof using clamps which secure the lid and drum into an engaged relationship. The lid and drum utilize a cammed engagement member so that as the clamps are activated the cammed surface provides a tightening of the lid to the drum.

17 Claims, 8 Drawing Sheets

OPEN TOP CONTAINER

FIELD OF THE INVENTION

The present invention relates to containers and more specifically to open top drums having releasably sealable lids for disposal of regulated and unregulated liquids and solids.

BACKGROUND OF THE INVENTION

Open top plastic containers comprising drums and lids are commonly used for containing liquids and solids. Such containers employ a variety of closure means for sealing the lid onto the drum.

In preferred open top containers, the opening of the drum is generally very large for easy access to the container. The lid should be formed so as to enable a sealed condition between the drum and the lid. This is especially important where the container is used for both regulated and unregulated liquids and solids.

Prior art sealable containers with locking covers are found in U.S. Pat. Nos. 5,143,389 and 4,585,138, both to Jonkers, U.S. Pat. No. 4,333,580 to Sweigart and U.S. Pat. No. 3,811,597 to Frankenberg et al as well as Norwegian Patent No. 7,503,452 owned by Wiva, N. V.

Concerns in providing containers for use in regulated solid and liquid disposal include storage of the component drums and lids prior to use, ease in sealing the containers, integrity of the seal and disposal of the containers when full or after terminal use. Additional concerns with sealing the lid on the drum include limiting excess parts as well as eliminating the use of tools and additional manpower.

It is therefore an object of the invention to provide a plastic container for receiving regulated and unregulated solids and liquids including a lid that is sealed on the drum.

It is a further object to provide a container having a drum, lid and sealing means which are entirely made of plastic and other incendiary materials so that incineration of the container does not leave any solid residue.

It is yet a further object of the invention to provide a closure means which is adapted to the lid and does not require additional tools or manpower to secure the lid to the drum.

It is still another object of the invention for the sealed container to meet United Nations seal standards for plastic containers of hazardous liquids.

SUMMARY OF THE INVENTION

These and other objects are achieved by the present invention directed to a container comprising a drum having an opening for receiving material and a circular flange about said opening, the flange having first engagement means associated therewith and a lid for covering the opening of the drum. The lid has second engagement means associated therewith for cooperating with the first engagement means. Also, one or more clamps for moving the first engagement means and the second engagement means into engagement and locking said engagement means into an engaged relationship are included.

At least one of the cooperating first or second engagement means has a cammed surface which contacts the cooperating engagement means when the one or more clamps are activated. This provides that, as the clamp is activated, the lid tightens down onto the drum for a more secure fit.

The drum is preferably circular and shaped so that the drum tapers up from base of the drum to the opening. This shape allows the base to fit within the opening of an adjacent drum for stacking and storage. Preferably, the volume of the drum of this invention is from 5 to 90 gallons.

Additionally, the lid has ribs for reinforcement, which, inter alia, cooperate with ribs on the bottom of the drum to allow stable stacking of full containers.

The clamps are preferably associated with and integral to the lid and are entirely made of plastic for complete incineration of the container. The clamps include a cammed surface so that when the clamps are activated the lid is rotated on the drum, moving the engagement means into engagement while tightening down the lid onto the drum.

BRIEF DESCRIPTION OF THE DRAWINGS

The following drawings, in which like characters represent like parts, are intended to illustrate the invention without limiting the invention in any manner whatsoever.

DESCRIPTION OF THE PREFERRED EMBODIMENT

As seen in the attached drawing FIGURES, the container 2 of the preferred embodiment of the present invention comprises an open top drum 4 and a clamp down lid 6. The entire container 2, including all parts thereof, is preferably made of incendiary material to allow it to burn to ashes with the contents thereof, i.e., for the disposal of hazardous materials.

Figure 1:
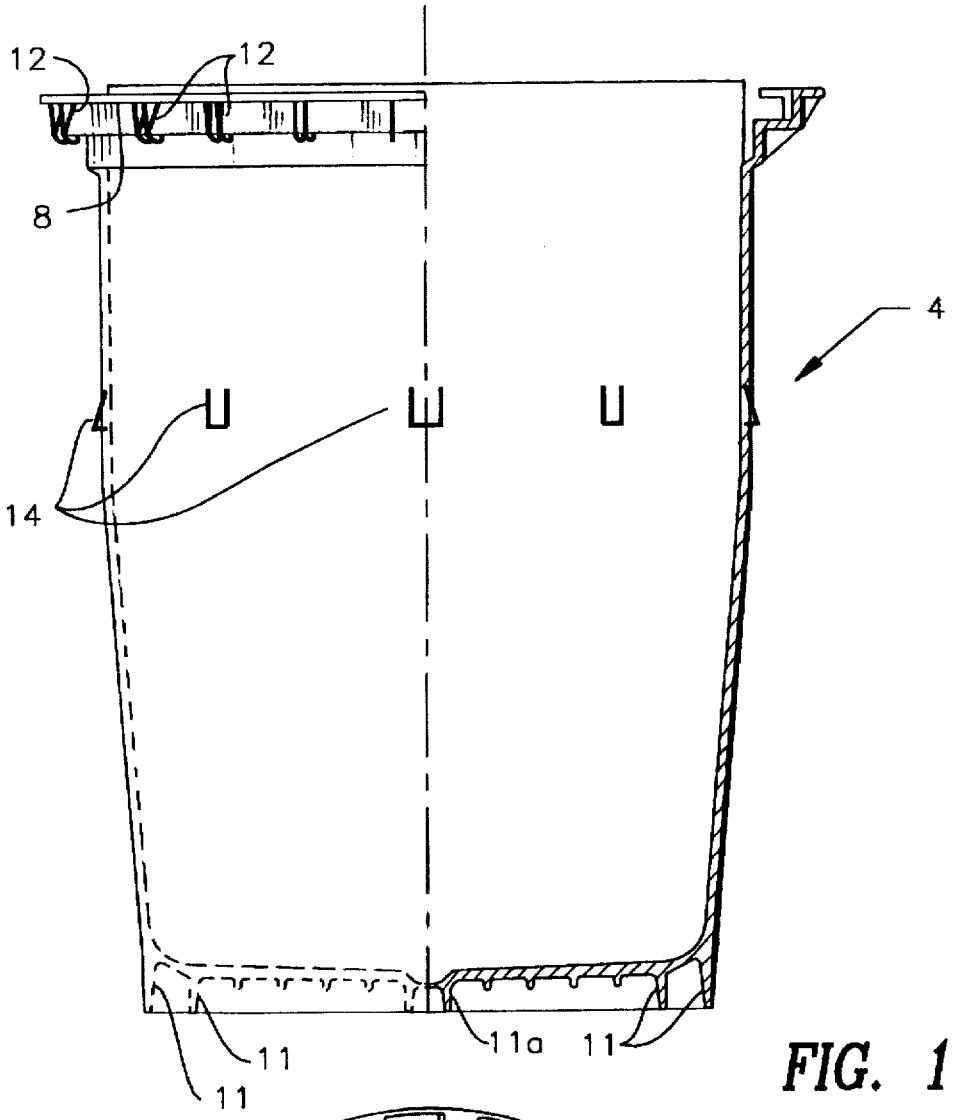
FIG. 1 is an elevational view of the drum of the present invention.
Figure 1A:
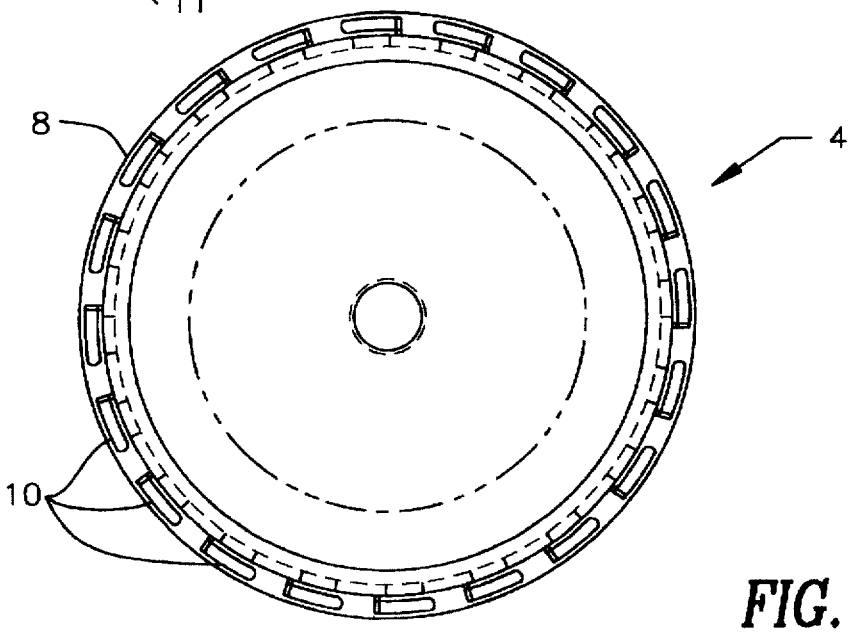
FIG. 1A is a top elevation view of the drum.

Turning to FIGS. 1 and 1A, the preferred drum 4 of the present invention has an open top for filling the drum 4. A circular flange 8 is provided about the opening. The flange 8 has slots 10 therein for engagement of the lid 6 with the drum 4. Ribs 12 are preferably provided around the flange 8 to the drum 4 to provide strength to the flange.

The preferred drum 4 holds a volume of from about 5 to about 90 U.S. gallons.

The shape of the drum 4 is preferably circular to allow nesting of empty drums 4 to minimize storage space. For this reason, the drums 4 are tapered outward from the base to a point toward the opening to allow insertion into an adjacent drum. Stops 14 are preferably incorporated on the side of the drum 4 to contact the edge of the opening of an adjacent drum and limit insertion therein, facilitating removal from an adjacent drum.

This shape additionally provides that full containers 2 can be stacked on each other where the base of the drum 4 fits atop the closed lid 6. Most preferably, the drum 4 has standing ribs 11 which provide structural integrity to the floor of the drum 4 and interlocking means for stabilizing the full drum 4 on the lid 6 of the container below when stacked.

In its most preferred embodiment, comprising a container for holding about 33.2 U.S. gallons volume, the internal opening diameter is about 19.6" and the external base diameter is about 17.4". The drum height is about 29.4" with sides tapering up at about 3.25° to normal to a point about 10.3" from the top of the drum 4.

The bottom of the stops 14 are most preferably set where the angle of the sides changes, i.e. 10.3" from the top in the foregoing example. Preferably, there are 8 evenly spaced stops 14 about the circumference of drum 4. Each stop 14 is most preferably about 1" wide and extends about ½" outwardly from the side of the drum 4 at the bottom of the stop, tapering upwardly to a point even with the wall of the drum 4 (see FIG. 1A).

Figure 2:
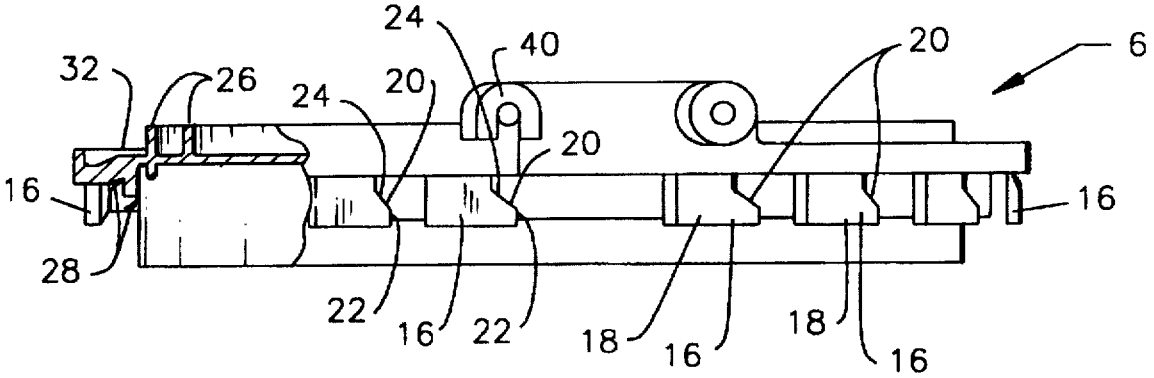
FIG. 2 is a side elevational view of the lid of the present invention in partial cross section.
Figure 2A:
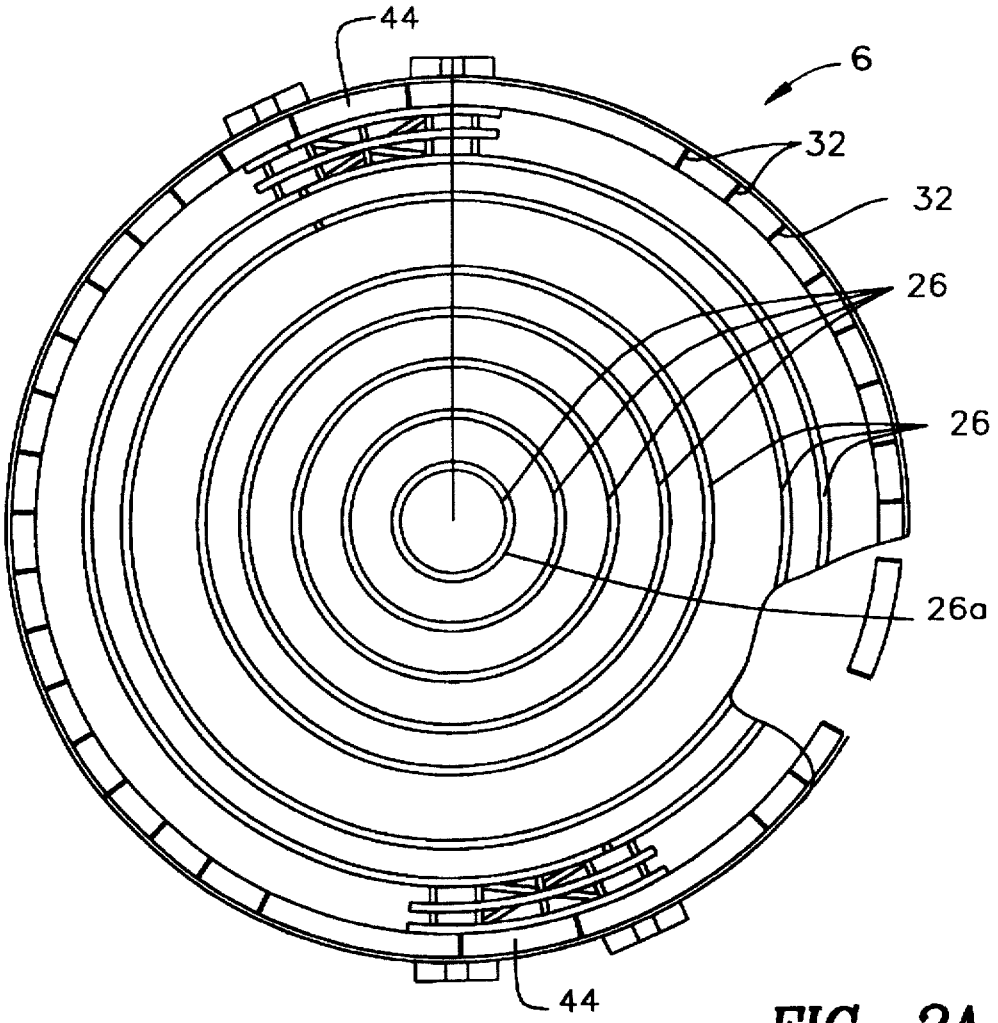
FIG. 2A is a top elevational view of the lid.

The lid 6, best seen in FIGS. 2 and 2A, fits over the drum 4 and has downwardly extending projections 16 about the perimeter for insertion into the slots in the flange 8 of the drum 4. The projections 16, have horizontal extensions 18, the top surface of which have a cammed face 20 which inclines from the open end 22 to the closed end 24.

Figure 2B:
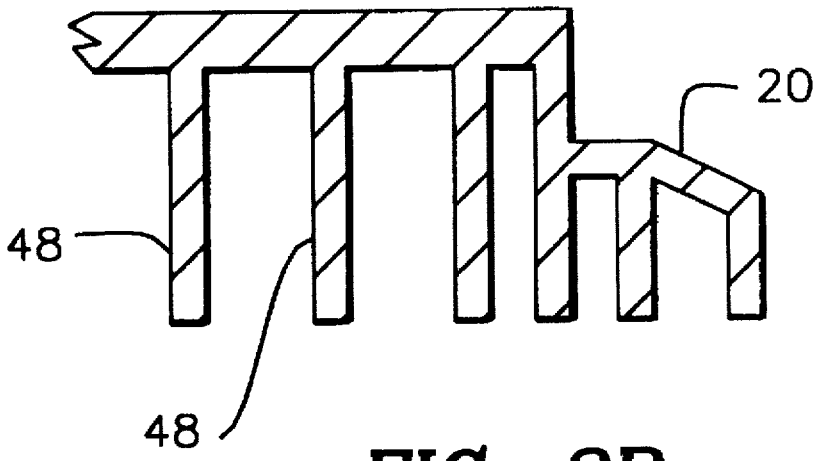
FIG. 2B is a detail front elevational view of a projection from the lid of FIG. 2A.
Figure 2C:
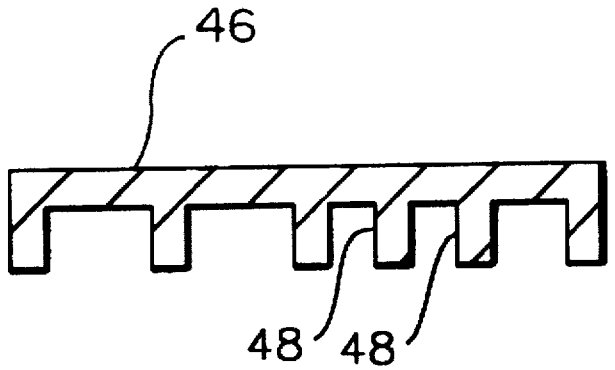
FIG. 2C is a detail bottom elevation of the projection of FIG. 2B.

In the most preferred embodiment the projections 16 are preferably formed with a vertical wall 46 having a series of ribs 48 normal thereto, as shown in FIGS. 2B and 2C. This configuration provides for ease of formation when produced by injection molding and increased strength of the projections 16.

Figure 3:
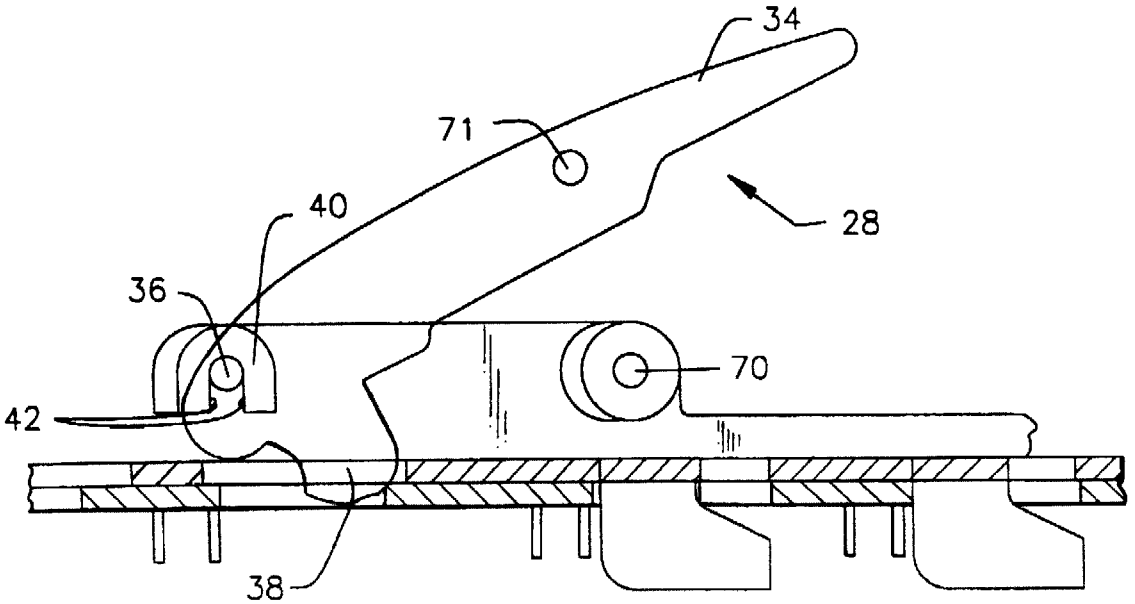
FIG. 3 is a partial cross sectional view of the lid on the drum with the clamp in its open configuration.
Figure 3A:
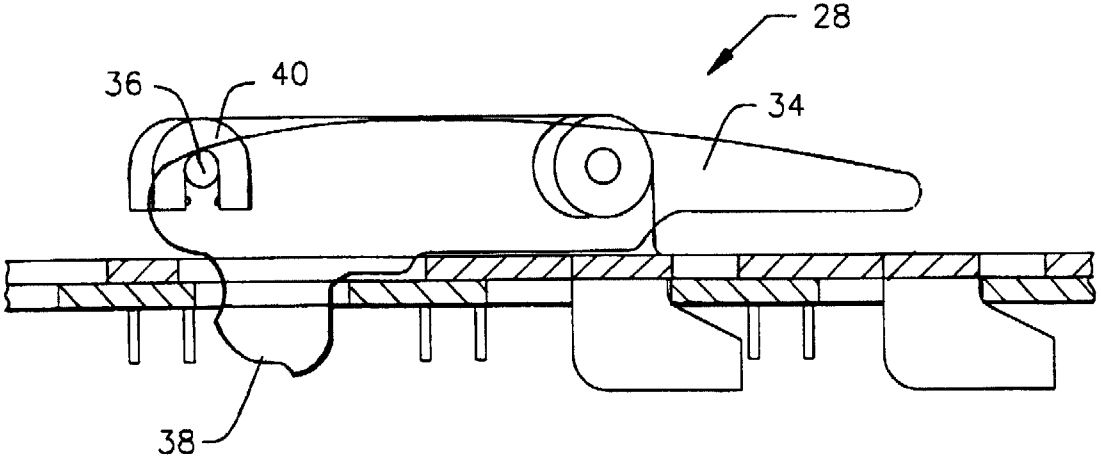
FIG. 3A is a partial cross sectional view of the lid on the drum with the clamp in its closed or locked configuration.
Figure 3B:
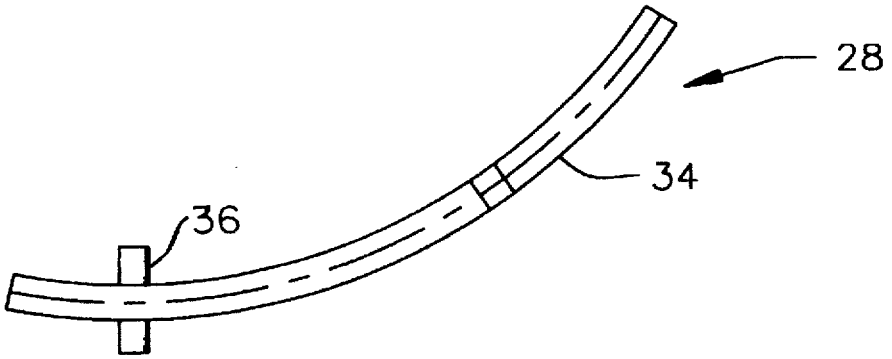
FIG. 3B is a top elevational view of the clamp.

The preferred lid 6 further comprises two (2) clamps 28 located 180° from each other across the lid 6. The preferred clamp 28, shown in FIGS. 3, 3A and 3B comprises a handle 34 pivotable about an axis 36, and a cam end 38. The axis 36 is retained on an axis retention member 40 with snap-in detents 42. The clamp 28 is preferably arcuate to fit in a slot 44 between the circular ribs 26.

To ensure that the clamp 28 does not open unintentionally, a handle lock 50 is utilized to lock the clamp 28 in its closed position. The handle lock 50 comprises a main body 52, an insertion member 54 and a friction detent 56.

When the handle 34 is in its locked position (see FIG. 3A), the insertion member 54 is inserted through holes in the mounting means (detailed below) and the hole 58 in the handle 34. This ensures the handle 34 will be retained in its closed position. The main body 52 is then rotated downwardly and the detent 56 is pressed between members of the mounting means.

Figure 4:
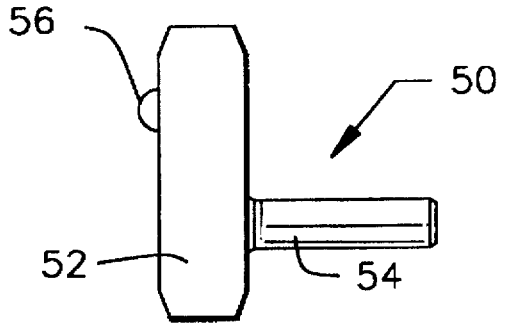
FIG. 4 is a front elevational view of the handle lock.
Figure 4A:
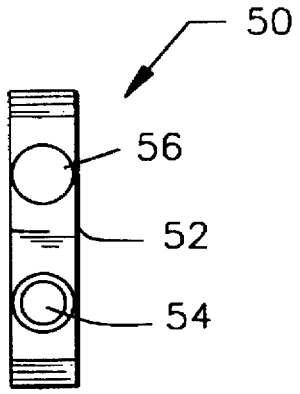
FIG. 4A is a side elevational view of the handle lock.
Figure 4B:
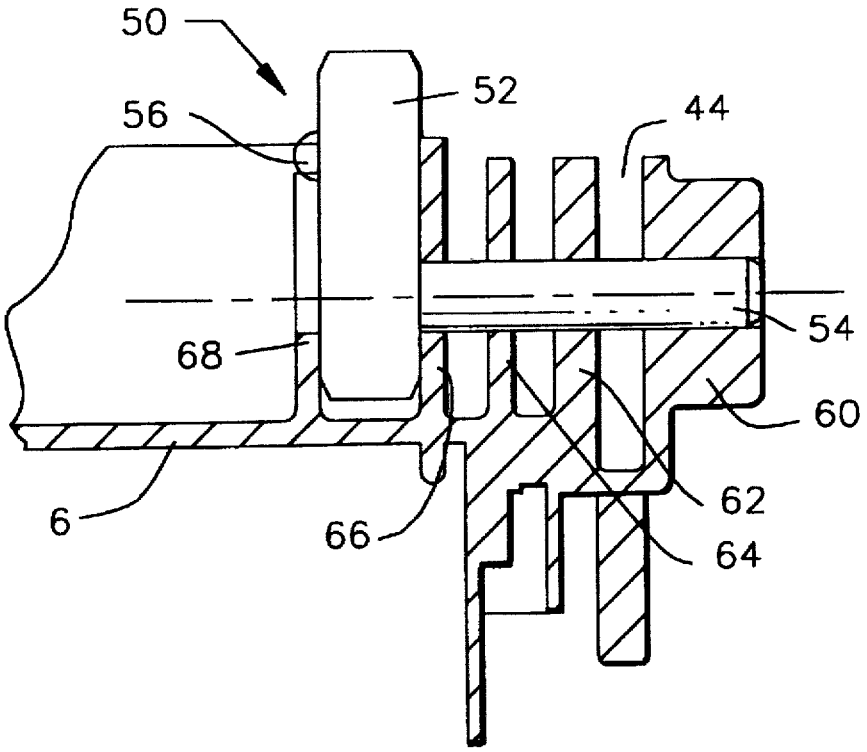
FIG. 4B is a cross sectional view of the handle lock in its inserted position on the lid.
Figure 5:
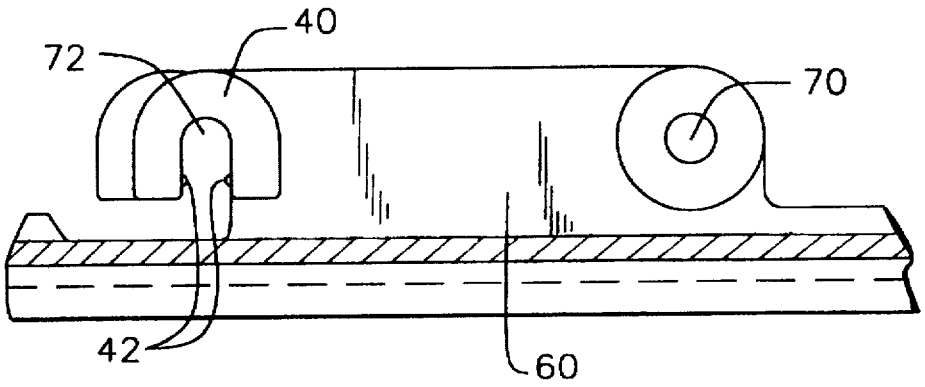
FIG. 5 is a partial elevation of the first clamp retention means member.
Figure 5A:
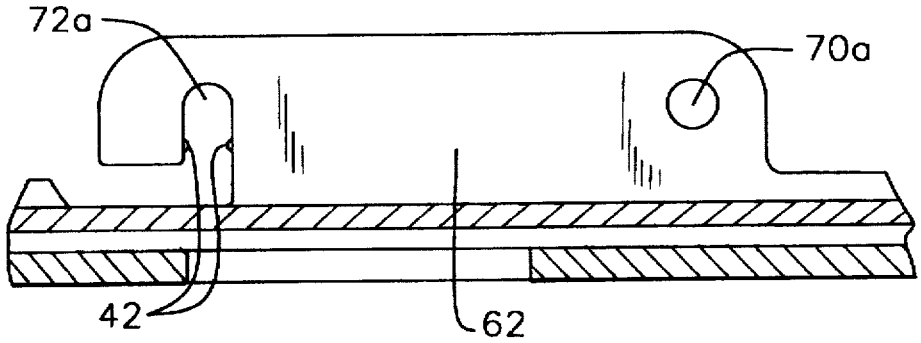
FIG. 5A is a partial elevation of the second clamp retention means member.
Figure 5B:
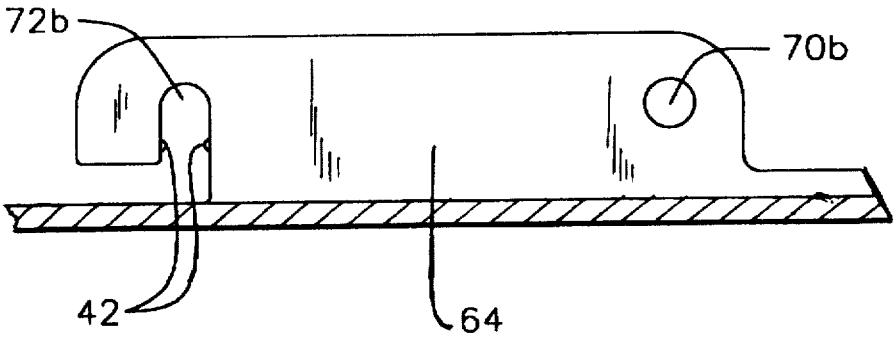
FIG. 5B is a partial elevation of the third clamp retention means member.
Figure 5C:
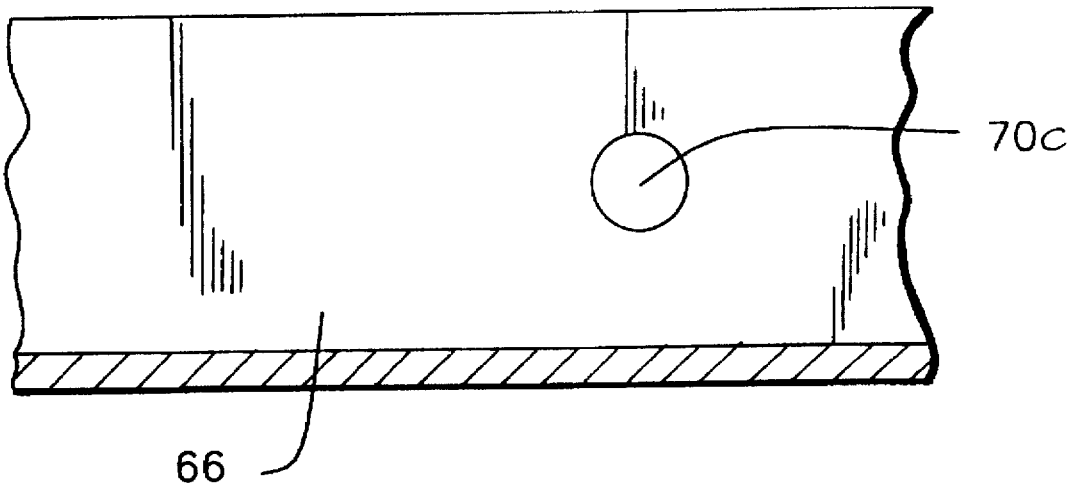
FIG. 5C is a partial elevation of the fourth clamp retention means member.
Figure 5D:
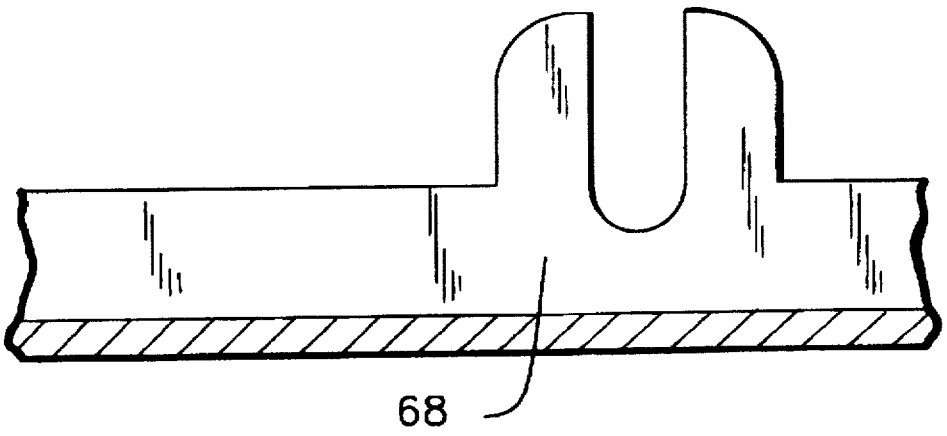
FIG. 5D is a partial elevation of the fifth clamp retention means member.

The mounting means for the clamps 28 preferably comprises a number of mounting members on the lid 6 of the container 2, as shown in FIG. 4B and FIGS. 5–5D. A first mounting member 60 is located at the outer edge of the lid 6 and is more particularly shown in FIG. 5. The first mounting member 60 is part of an external rim 26 about the lid and includes the axis retention member 40, a slot 72 for receiving the axis 36 as well as a hole 70 for receiving the lock insertion member 54.

Similarly, a second mounting member 62 (shown in FIG. 5A) has a slot 72*a* for receiving the axis 36 of the clamp 28 and a hole 70*a* for receiving the insertion member 54 of the handle lock 50. The slot 72*a* also has detents 42 for retaining the axis. Likewise, a third mounting member 64 (shown in FIG. 5B) includes a slot 72*b* for receiving the axis 36 and a hole 70*b* for receiving the insertion member 54.

The fourth mounting member 66 (FIG. 5C) has a hole 70*c* for receiving the insertion member 54. Finally, fifth mounting member 68 has a slot 74 for entry of the insertion member 54 and main body 52 of the handle lock 50. After the insertion member 54 passes through all of the holes 70, 70*a*, 70*b* and 70*c* of the mounting members 60, 62, 64, and 66 respectively, as well as the hole 71 of the handle 34 in its closed position, the main body 52 enters upright through the slot 74. Once the main body 52 is through the slot 74, the main body 52 is rotated downwardly, so that it cannot move out of the slot 74, to lock the clamp 28 in its closed position. When the main body 52 is rotated to its full downward position the detent 54 is friction fit between the ribs 26 on the lid 6.

The preferred lid 6 further includes a number of circular ribs 26 to provide structural strength to the lid 6. Most preferably, the ribs 26 are about ¾" high. Additionally, outward ribs 32 are preferably provided above the area of the projections 16 to ensure strength at the area of engagement to the drum 4. Preferably, the mounting members 60–66 are incorporated in said ribs 26.

In its preferred embodiment, the ribs 26 on the top of the lid 6 are spaced so as to cooperate with the standing ribs 11 on the bottom of the drum 4 to provide stability when full containers 2 are stacked upon each other. Most preferably, the innermost rib 26*a* on the lid 6 is sized so as to accept the inner standing rib 11*a* on the drum bottom, as well as more outer ribs 26 cooperating with the outer standing ribs 11.

Figure 6:
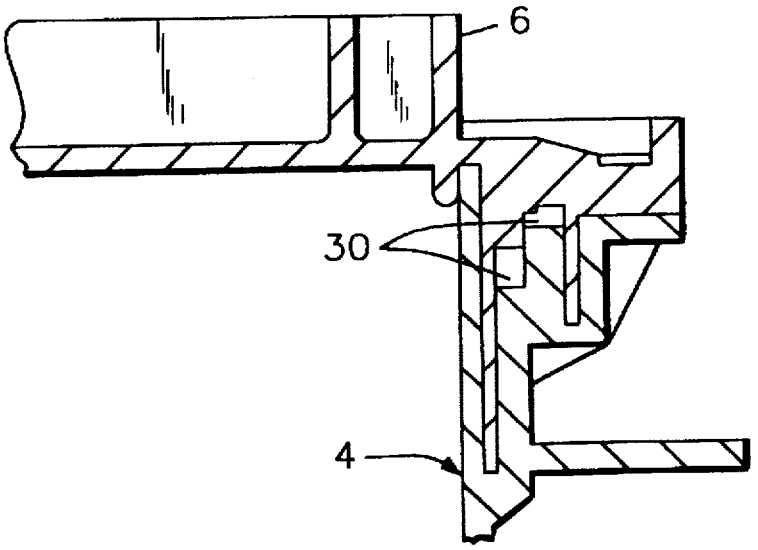
FIG. 6 is a cross sectional view of the lid mounted on the drum.

Preferably, the lid 6 further includes one or more gaskets 30 to provide a sealed condition between the lid 6 and the drum 4. Rubber or rubber/plastic composite O-type, square or U-type gaskets are preferred, with O-type or square being most preferred. Preferred placement of the gaskets 30 is best seen in FIG. 6 where the lid 6 is shown mounted on the drum 4 in cross section.

The container 2 can be made of any suitable plastic, with a high molecular weight polyethylene resin being most preferred. Similarly, any forming technique can be used, including blow molding, rotational molding or injection molding with injection molding being most preferred with the preferred high molecular weight polyethylene described above.

Various modifications to the above invention will become apparent to those skilled in the art, all of which are intended to fall within the spirit and scope of the present invention, limited only by the appended claims. All references cited herein are hereby incorporated by reference.

We claim:

1. A container comprising:

a drum having an opening for receiving material to be contained therein and a circular flange about said opening, said flange having a first engagement means associated therewith, a lid for covering said opening on said drum, said lid having a second engagement means associated therewith and cooperating with said first engagement means, one or more clamps comprising means for rotating the lid and locking the first and second engagement means into an engaged relationship, wherein said first engagement means comprises slots in the flange for receiving said second engagement means and further wherein at least one of said cooperating first or second engagement means comprises a cammed surface which contacts the cooperating engagement means when the one or more clamps are activated to draw the lid down onto the drum.

2. The container of claim 1 further comprising gasket means for providing a seal between the lid and the drum when the engagement means are in the engaged relationship.

3. The container of claim 1 further comprising means for stacking when in the engaged relationship comprising stacking means on a bottom of the drum which cooperate with stacking means on a top of the lid.

4. The container of claim 1 wherein the container has a volume of from about 5 to about 90 U.S. gallons.

5. The container of claim 1 wherein the drum further comprises sides which are tapered for nesting when empty.

6. The container of claim 5 further comprising a plurality of stops on the sides to limit insertion of a nested drum.

7. The container of claim 1 wherein the second engagement means comprises a projection including a cam surface, at least a portion of said cam surface being insertable into the slot of the first engagement means.

8. The container of claim 7 wherein the cam surface of the second engagement means comprises an angled surface.

9. The container of claim 8 wherein when the cam surface is inserted into the slot, an end wall of the slot contacts a portion of the cam surface of the projection and draws down the lid when the lid is rotated so that the end of the slot moves across the cam surface.

10. The container of claim 9 wherein the means for rotating of the one or more clamps comprises an axis, a lever and a cam wherein when said lever is activated about said axis from an open position to a closed position said cam contacts an end wall of a slot on the drum flange to rotate the lid on the drum and move the first and second engagement means into the engaged relationship.

11. The container of claim 10 comprising two clamps diametrically disposed across from each other on the lid.

12. The container of claim 1 further comprising means for locking the one or more clamps into a closed position.

13. The container of claim 12 wherein the entire container is made of incendiary materials.

14. The container of claim 13 wherein the container is made of high molecular weight polyethylene.

15. The container of claim 14 further comprising one or more gaskets for creating a seal between the lid and the drum.

16. The container of claim 15 wherein the gasket is made of rubber.

17. The container of claim 15 wherein the gasket is made of a rubber/plastic composite.

* * * * *